US007246582B2

(12) United States Patent
Miyakoshi

(10) Patent No.: US 7,246,582 B2
(45) Date of Patent: Jul. 24, 2007

(54) VARIABLE VALVE CONTROL APPARATUS AND VARIABLE VALVE CONTROLLING METHOD FOR INTERNAL COMBUSTION ENGINE

(75) Inventor: Ryo Miyakoshi, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/374,153

(22) Filed: Mar. 14, 2006

(65) Prior Publication Data

US 2006/0207539 A1 Sep. 21, 2006

(30) Foreign Application Priority Data

Mar. 17, 2005 (JP) ..... 2005-076246

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

2005/0098127 A1* 5/2005 Eiraku ..... 123/90.15

FOREIGN PATENT DOCUMENTS

JP 10-153104 6/1998

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

The rotational acceleration of an engine is calculated based on a detection value of an engine rotating speed, the inertia torque to be transmitted to a variable valve mechanism, such as a variable valve timing control mechanism or the like, is calculated based on the rotational acceleration, a correction amount of a manipulated variable for the variable valve mechanism, which is in compliance with the inertia torque, is calculated, and the manipulated variable for the variable valve mechanism is corrected with the correction amount according to the inertia torque, to thereby control the variable valve mechanism based on the corrected manipulated variable.

19 Claims, 12 Drawing Sheets

VARIABLE VALVE CONTROL APPARATUS AND VARIABLE VALVE CONTROLLING METHOD FOR INTERNAL COMBUSTION ENGINE

BACKGROUND OF THE INVENTION

1. Field of the Invention

The present invention relates generally to a variable valve control apparatus and method for an internal combustion engine provided with a variable valve mechanism which varies valve characteristics, such as a variable valve timing mechanism which varies opening/closing timing of an engine valve (intake valve/exhaust valve).

2. Description of the Related Art

Japanese Unexamined Patent Publication No. 10-153104 discloses a variable valve timing mechanism having a configuration in which a rotation phase of a camshaft relative to a crankshaft in an internal combustion engine is changed by the braking of an electromagnetic brake or a solenoid brake so that opening/closing timing of an engine valve is varied.

In the variable valve timing mechanism described above, since the rotation phase is determined by the balance of the torque in an advance angle direction by an electromagnetic force of the electromagnetic brake with the torque in a retarded angle direction by a return spring, the rotation phase might be changed by the inertia torque generated when an engine rotating speed is changed.

Although the rotation phase changed as in the above manner is converged into a target value by a feedback control, it takes much time until the rotation phase is converged. Therefore, there is a problem of degradation in combustion performance due to a phase change during the convergence.

SUMMARY OF THE INVENTION

It is, therefore, an object of the present invention to promptly converge a rotation phase into a target value of valve characteristics even when an engine rotating speed is changed, to thereby suppress the degradation in combustion performance due to a phase change.

In order to achieve the above object, according to the present invention, the rotational acceleration of an engine is calculated based on a detection value of an engine rotating speed, an inertia torque to be transmitted to a variable valve mechanism is calculated based on the rotational acceleration, a correction amount of a manipulated variable for the variable valve mechanism, which amount is in compliance with the inertia torque, is calculated, and the manipulated variable for the variable valve mechanism is corrected with the calculated correction amount, whereby the variable valve mechanism is controlled based on the corrected manipulated variable.

The other objects and features of the invention will become understood from the following description with reference to the accompanying drawings.

DESCRIPTION OF PREFERRED EMBODIMENT

Figure 1:
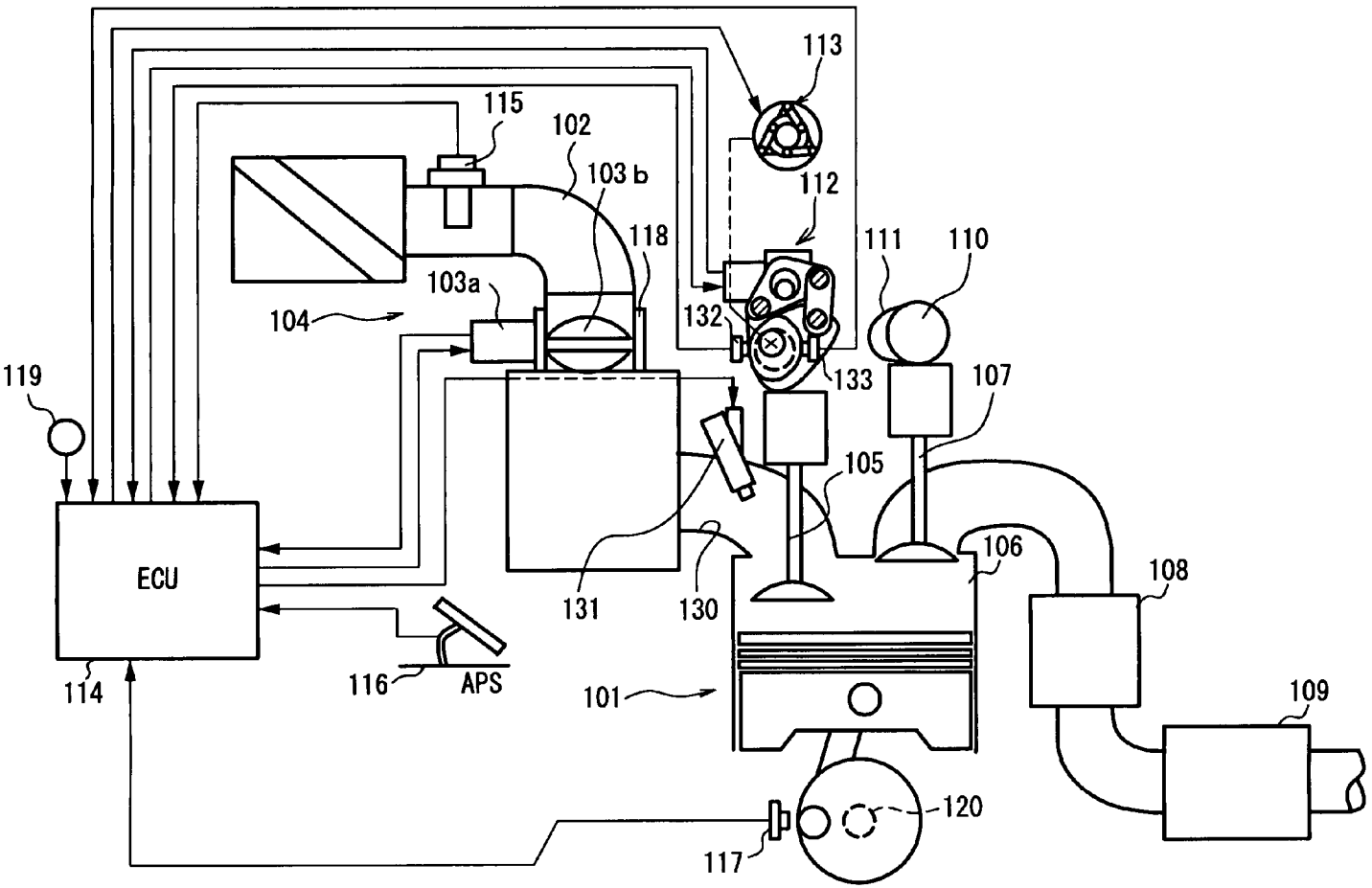
FIG. 1 is a systematic diagram of an internal combustion engine in an embodiment of the invention.

FIG. 1 is a systematic diagram of an internal combustion engine for vehicle in an embodiment of the invention.

In FIG. 1, on an intake pipe 102 of an internal combustion engine 101, an electronically controlled throttle 104 is disposed.

Electronically controlled throttle 104 is a device for driving opening or closing of a throttle valve 103*b* by a throttle motor 103*a*.

Then, air is drawn into a combustion chamber 106 of engine 101 via electronically controlled throttle 104 and an intake valve 105.

A combusted exhaust gas of engine 101 is discharged from combustion chamber 106 via an exhaust valve 107, and then, is purified by a front catalyst 108 and a rear catalyst 109, thereafter, to be emitted into the atmosphere.

Exhaust valve 107 is driven to open or close by a cam 111 axially supported by an exhaust side camshaft 110, while maintaining a fixed lift amount, a fixed valve operating angle and fixed valve timing thereof.

On the other hand, on the intake valve 105 side, there is disposed a variable valve event and lift (VEL) mechanism 112 which continuously varies a lift amount of intake valve 105 together with an operating angle thereof.

Further, on the intake valve 105 side, there is disposed a variable valve timing control (VTC) mechanism 113 which changes a rotation phase of an intake side camshaft relative to a crankshaft 120, to continuously vary a center phase of the operating angle of intake valve 105.

An engine control unit (ECU) 114 incorporating therein a microcomputer, controls VEL mechanism 112 and VTC mechanism 113 so as to obtain a required intake air amount, a required cylinder residual gas rate and the like corresponding to the required torque, and also, carries out controlling of electronically controlled throttle 104 so as to obtain a required intake negative pressure.

ECU 114 receives detection signals from an air flow meter 115 for detecting an intake air amount of internal combustion engine 101, an accelerator pedal sensor 116 for detecting an accelerator opening, a crank angle sensor 117 for taking out a unit angle signal POS for each unit crank angle from crankshaft 120, a throttle sensor 118 for detecting an opening TVO of throttle valve 103*b*, a water temperature sensor 119 for detecting the cooling water temperature of internal combustion engine 101, and a cam sensor 132 for taking out a cam signal CAM from the camshaft.

Figure 2:
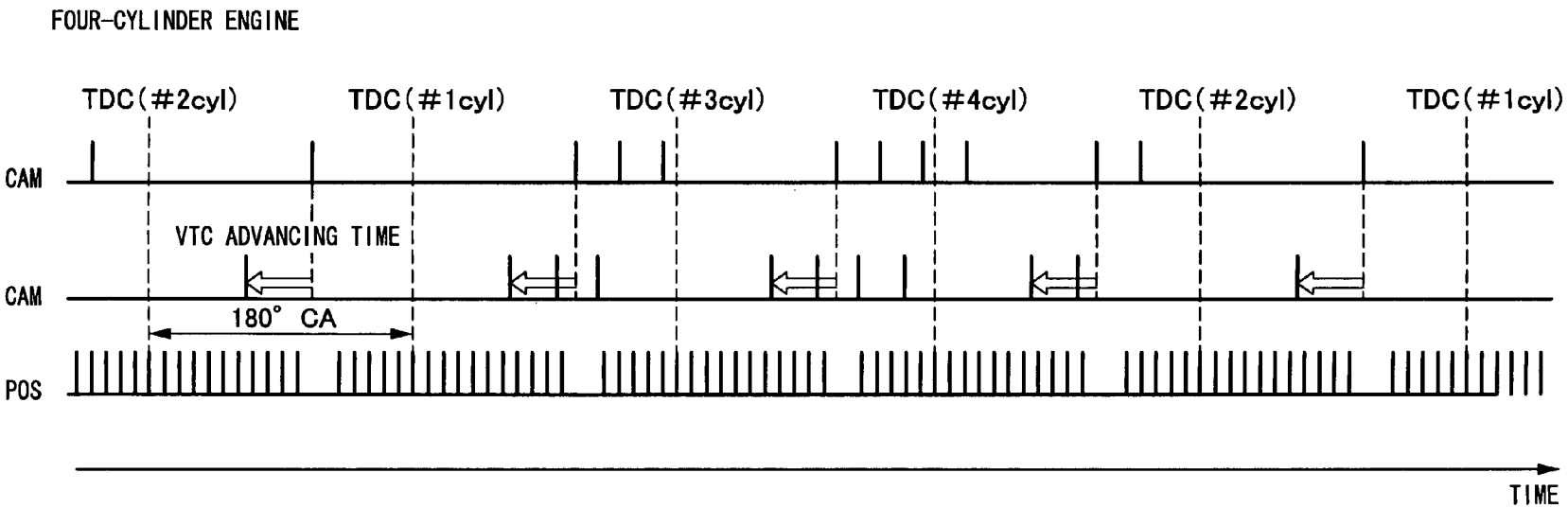
FIG. 2 is a timing chart showing output signals from a crank angle sensor and a cam sensor.

Here, crank angle sensor 117 detects a portion to be detected which is disposed at each crank angle of 10° to a rotating body rotated integrally with crankshaft 120, to thereby output the unit angle signal POS at each crank angle of 10° as shown in FIG. 2. In FIG. 2, two consecutive portions to be detected are removed at two different positions spaced apart by an interval of the crank angle of 180°, so that two consecutive unit angle signals POS are not output.

The crank angle of 180° is equivalent to a stroke phase difference between cylinders in a four-cylinder engine in the present embodiment.

Then, a portion where the output of the unit angle signal POS is temporarily stopped, is detected based on an output period of the unit angle signal POS or the like, and a reference rotational position of crankshaft 120 is detected on the basis of, for example, the unit angle signal POS which is first output after the output of the unit angle signal POS has been stopped.

ECU 114 calculates an engine rotating speed by counting the detection cycle of the reference rotational position or the generation frequency of the unit angle signals POS per a predetermined period of time.

Incidentally, crank angle sensor 117 may be configured to individually output a reference angle signal REF at each reference rotational position (every 180° position) of crankshaft 120, and the unit angle signal POS of which the output is not stopped.

Further, cam sensor 132 detects portions to be detected which are disposed to a rotating body integrally rotatable with the camshaft, to output a cam signal CAM indicating, by the number of pulses, the cylinder number (a first cylinder to a fourth cylinder) at each cam angle of 90° equivalent to the crank angle of 180°, as shown in FIG. 2.

Then, an angle of from the reference rotational position of crankshaft 120 to a reference rotational position of a camshaft 13, which is detected by the cam signal CAM, is measured by counting the unit angle signals POS, and the rotation phase (an actual rotation phase) of the camshaft relative to crankshaft 120 is detected based on the measured angle.

To be specific, a counter is made to count up at each generation of the unit angle signal POS, and also, the counter is made to reset to 0 at the reference rotational position of crankshaft 120, so that, at each time when the cam signal CAM (a leading signal at each crank angle of 180°) is output, a value of the counter at the time is determined to thereby detect the actual rotation phase.

Returning to FIG. 1, a fuel injection valve 131 of electromagnetic type is disposed on an intake port 130 at the upstream side of intake valve 105 for each cylinder.

Fuel injection valve 131 is driven to open based on an injection pulse signal from ECU 114 to inject fuel with an amount proportional to the injection pulse width of the injection pulse signal.

Next, there will be described based on FIG. 3 through FIG. 10, a configuration of VTC mechanism 113 serving as a variable valve mechanism to which the present invention is applied.

Figure 3:
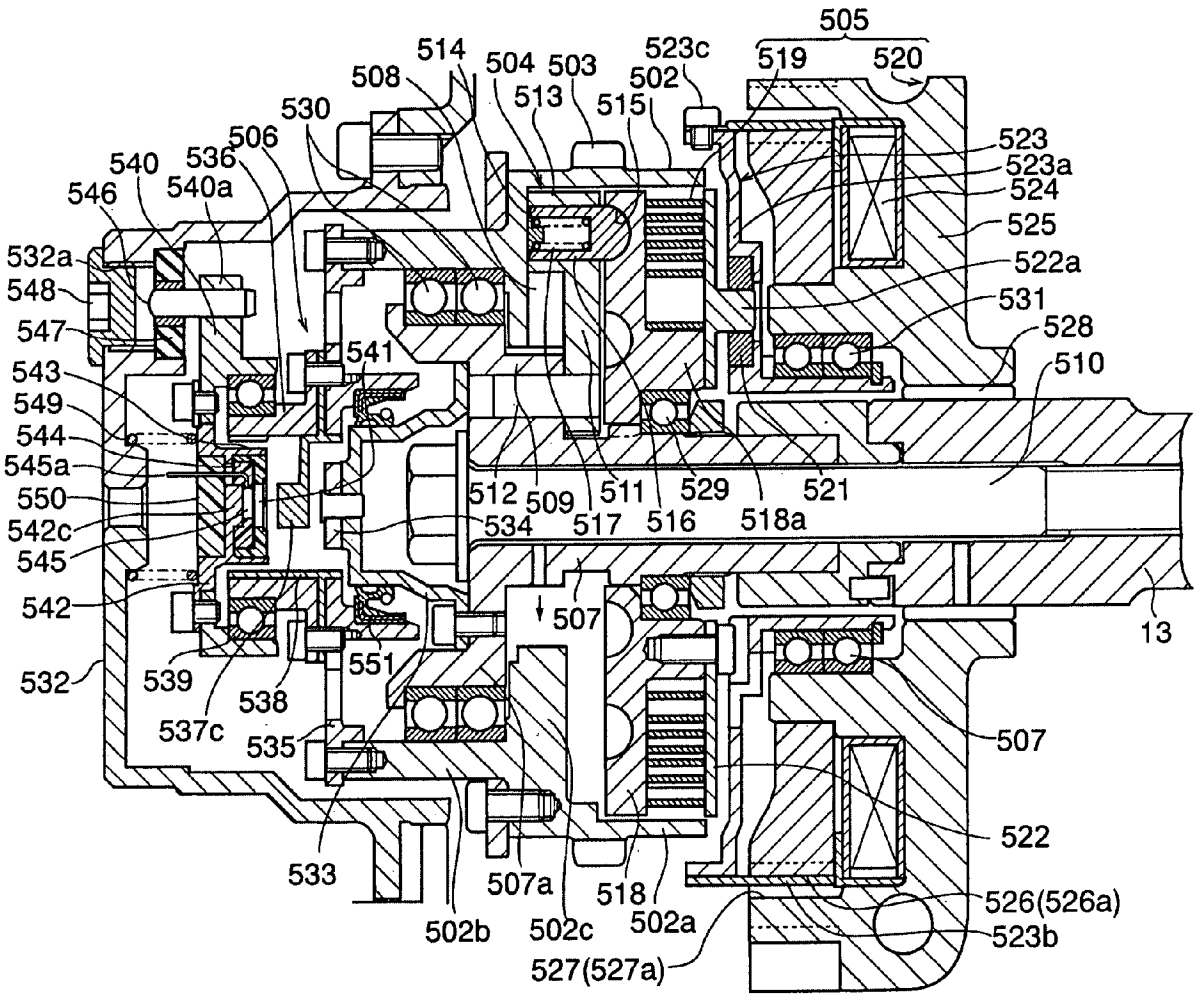
FIG. 3 is a cross section showing a variable valve timing control mechanism.

VTC mechanism 113 comprises: a timing sprocket 502 which is assembled to a front end portion of camshaft 13 so as to be relatively rotatable with camshaft 13, as shown in FIG. 3, and is linked to crankshaft 120 via a timing chain (not shown in the figure); assembling angle altering means 504 disposed on the inner periphery side of timing sprocket 502, for altering an assembling angle between timing sprocket 502 and camshaft 13; operating force applying means 505 for driving assembling angle altering means 504; relative displacement detecting means 506 for detecting a relative rotation displacement angle of camshaft 120 relative to timing sprocket 502; and a VTC cover 532 which covers front faces of assembling angle altering means 504 and relative displacement detecting means 506.

Relative displacement detecting means 506 comprises: a magnetic field generating mechanism disposed on the side of a driven shaft member 507; and a sensor mechanism disposed on the side of VTC cover 532 which is the fixing portion side, for detecting a change in the magnetic field from the magnetic field generating mechanism (533 through 551), and is able to detect, at arbitrary timing, the relative rotation displacement angle, that is, the rotation phase (the actual rotation phase) of camshaft 13 relative to crankshaft 120, based on the change in the magnetic field.

Here, in a first detecting method for detecting the actual rotation phase based on the angle spanning from the reference rotational position of crankshaft 120 to the reference rotational position of camshaft 13, although the detection accuracy thereof is high, the actual rotation phase can be detected only at each output of the cam signal CAM, namely only at each stroke phase difference between the cylinders. Therefore, when the rotation fluctuation of the engine is large, such as, when an operation of the engine is started, the deviation between the actual rotation phase and a rotation phase detection value detected in a previous time becomes large during a period of time until the detection value is updated, and accordingly, a feedback control cannot be performed satisfactorily.

In the present embodiment, the rotation phase detection value is updated at each time when the rotation phase is detected according to the first detecting method, and also, the detection value detected by relative displacement detecting means 506 is used during the period of time until the detection value is updated, so that the satisfactory feedback control can be performed even when the rotation fluctuation is large.

To an end portion of camshaft 13, driven shaft member 507 is fixed by means of a cam bolt 510.

A flange 507*a* is disposed to be integral with driven shaft member 507.

Timing sprocket 502 is provided with: a cylindrical portion 502*a* of large diameter on which is formed a teeth portion 503 to be engaged with the timing chain; a cylindrical portion 502*b* of small diameter; and a circular plate portion 502*c* connecting between cylindrical portion 502*a* and cylindrical portion 502*b*.

Cylindrical portion 502*b* is rotatably assembled on flange 507*a* of driven shaft member 507 via a ball bearing 530.

Figure 4:
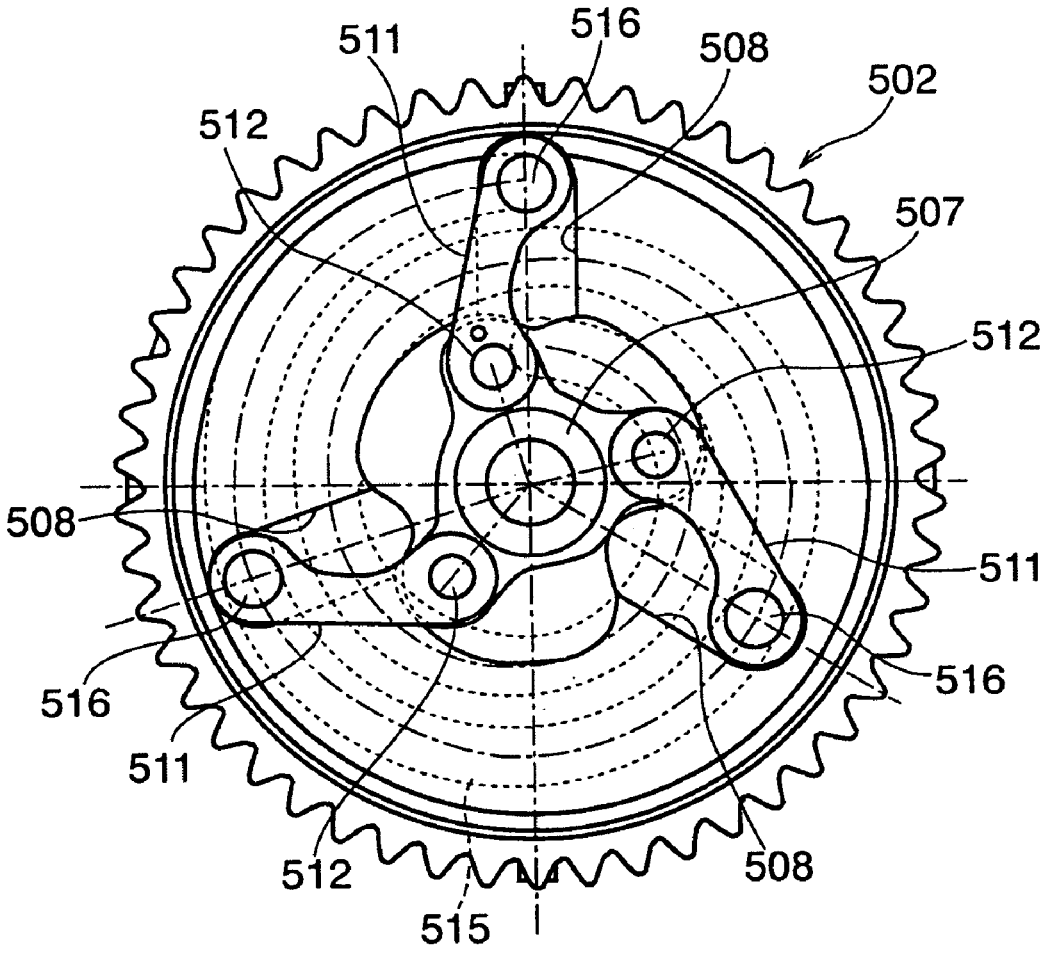
FIG. 4 is a diagram showing a state for when an intake valve is controlled to be in the most retarded position by the variable valve timing control mechanism.
Figure 5:
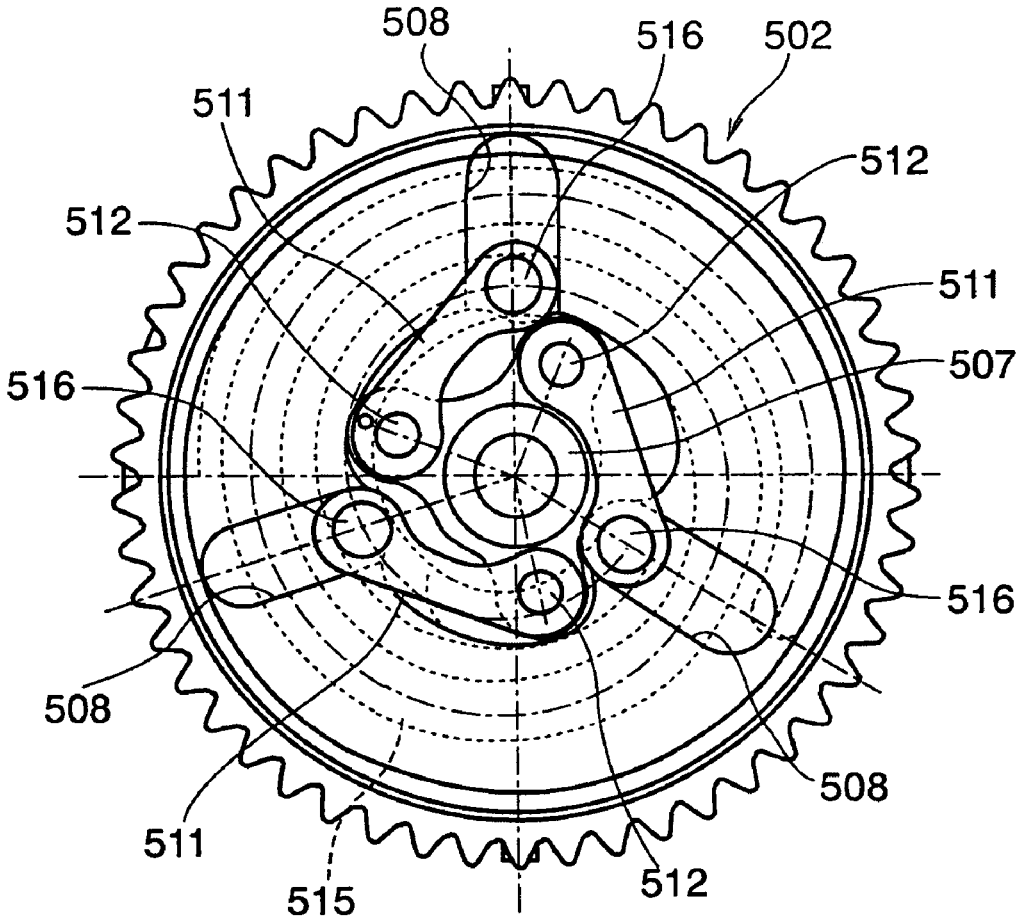
FIG. 5 is a diagram showing a state for when the intake valve is controlled to be in the most advanced position by the variable valve timing control mechanism.
Figure 6:
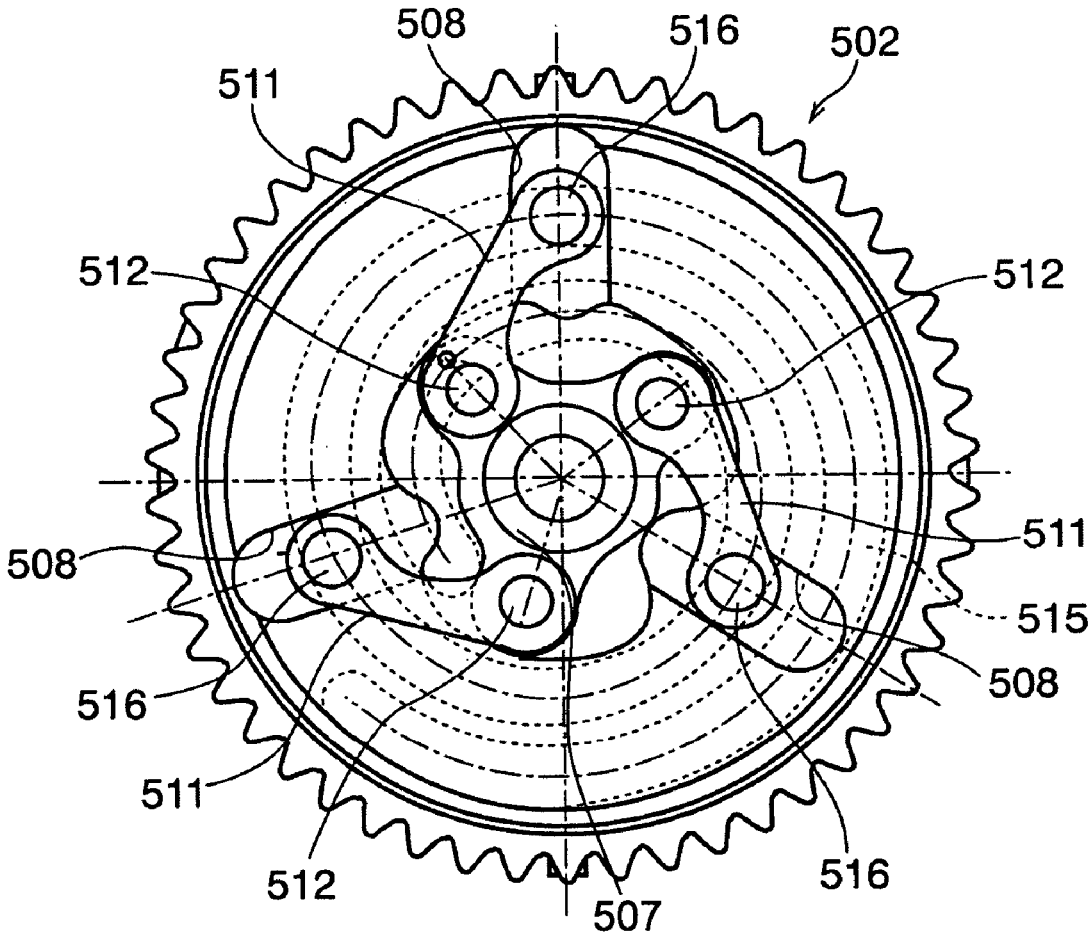
FIG. 6 is a diagram showing a state for when the intake valve is controlled to be in an intermediately advanced position by the variable valve timing control mechanism.

On a surface on the side of cylindrical portion 502*b*, of cylindrical portion 502*c*, as shown in FIG. 4 through FIG. 6, three radial grooves 508 are formed to extend radially along a radial direction of timing sprocket 502.

Further, an end face of flange portion 507*a* of driven shaft member 507, which is located on the side of camshaft 13, is integrally formed therein with three protruding portions 509 protruding radially in a radial direction.

To respective protruding portions 509, base ends of three links 511 are respectively rotatably connected in a manner to be rotatable about pins 512.

On a tip end of each link 511, a cylindrical ejecting portion 513 is integrally formed, which is slidably engaged in each radial groove 508.

Since each link 511 is connected to driven shaft member 507 by means of pin 512 in a state where each ejecting portion 513 is engaged in radial groove 508 corresponding thereto, when the tip end side of each link 511 receives an external force to be displaced along radial groove 508, timing sprocket 502 and driven shaft member 507 are relatively rotated due to an action of each link 511.

Further, on ejecting portion 513 of each link 511, a reception hole 514 which is opened toward the camshaft 13 side is formed.

An engagement pin 516 to be engaged with a spiral groove 515 (to be described later) and a coil spring 517 urging engagement pin 516 toward the spiral groove 515 side, are received in reception hole 514.

On the other hand, an intermediate rotating body 518 of circular plate shape is supported to be rotatable via a bearing 529 by driven shaft member 507 positioned on the camshaft 13 side of protruding portion 509.

An end face of intermediate rotating body 518, which is located on the side of protruding portion 509, is formed therein with a spiral groove 515, and engagement pin 516 on the tip end of each link 511 is engaged in spiral groove 515.

Spiral groove 515 is formed so as to gradually reduce a diameter thereof along a rotating direction of timing sprocket 502.

Accordingly, in a state where each engagement pin 516 is engaged with spiral groove 515 corresponding thereto, when intermediate rotating body 518 is relatively displaced to timing sprocket 502 in a retarded direction, the tip end portion of each link 511 is induced to spiral groove 515 to move inward in the radial direction, while being guided by radial groove 508.

Contrary to the above, when the intermediate rotating body 518 is relatively displaced to timing sprocket 502 in an advance direction, the tip end portion of each link 511 moves outward in the radial direction.

Assembling angle altering means 504 is provided with: each radial groove 508 of timing sprocket 502; each link 511, each ejecting portion 513; each engagement pin 516; intermediate rotating body 518; spiral groove 515 and the like.

When a rotational operating force is input to intermediate rotating body 518 from operating force applying means 505, the tip end of link 511 is displaced in the radial direction, and this displacement is transmitted via link 511 as a rotating force for changing a relative displacement angle between timing sprocket 502 and driven shaft member 507.

Operating force applying means 505 is provided with: a spiral spring 519 urging intermediate rotating body 518 to the rotating direction of timing sprocket 502; and a hysteresis-brake 520 for generating a braking force which rotates intermediate rotating body 518 to a direction opposite to the rotating direction of timing sprocket 502.

Here, ECU 114 controls the braking force of hysteresis-brake 520 according to the operating condition of internal combustion engine 101, so that intermediate rotating body 518 can be rotated relatively to timing sprocket 502 to a position where the urging force of spiral spring 519 and the braking force of hysteresis-brake 520 are balanced with each other.

Figure 7:
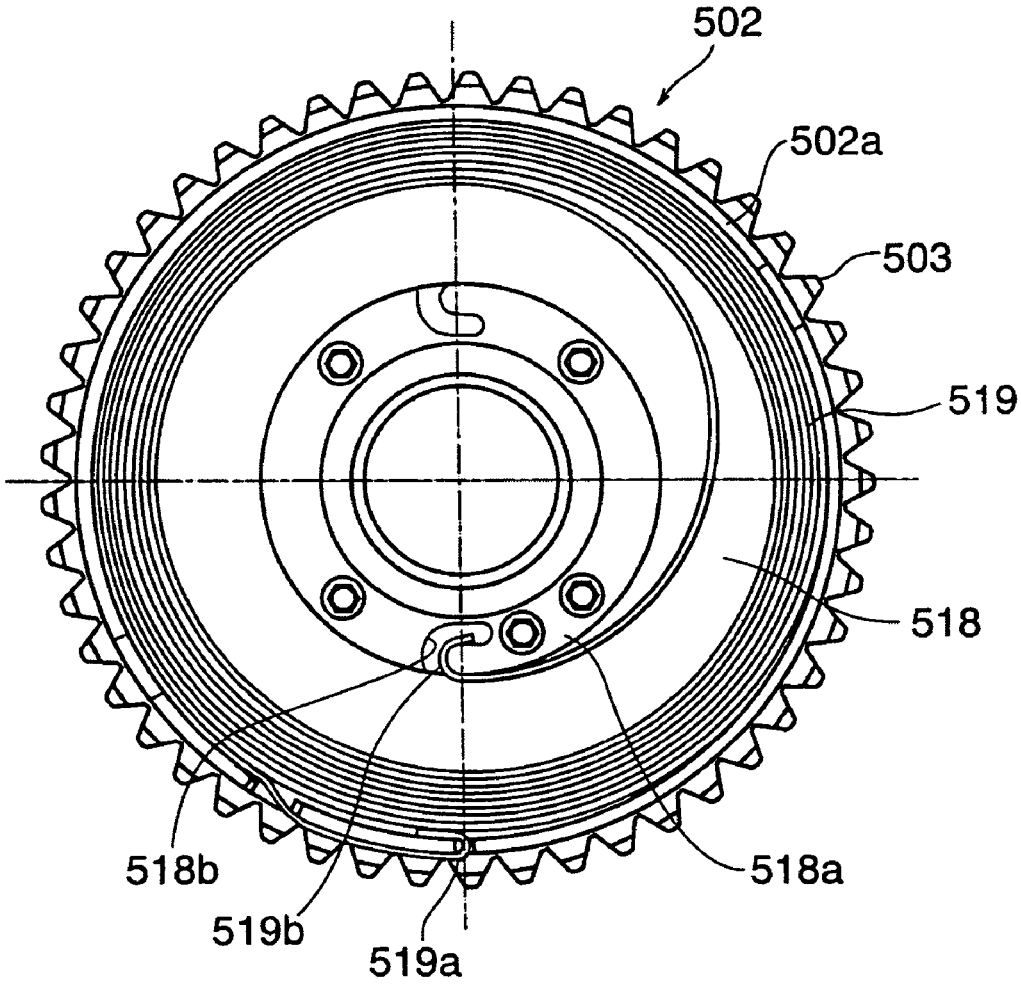
FIG. 7 is a diagram showing an attachment state of a spiral spring in the variable valve timing control mechanism.
Figure 8:
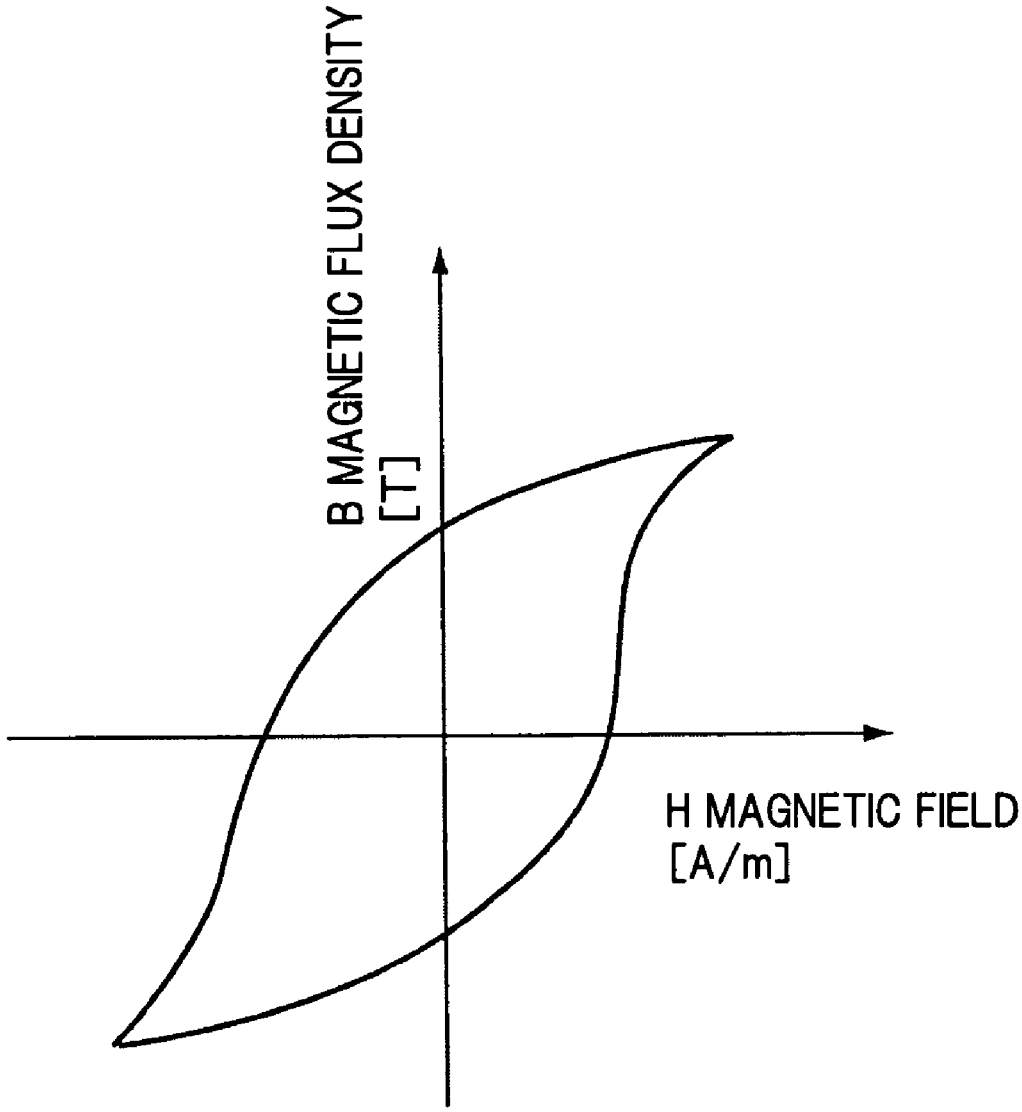
FIG. 8 is a graph showing a changing characteristic of magnetic flux density of a hysteresis material in the variable valve timing control mechanism.

As shown in FIG. 7, spiral spring 519 is arranged in cylindrical portion 502*a* of timing sprocket 502, and an outer peripheral end portion 519*a* thereof is engaged with the inner periphery of cylindrical portion 502*a*, while an inner peripheral end portion 519*b* thereof being engaged in an engagement groove 518*b* of a base portion 518*a* of intermediate rotating body 518.

Hysteresis-brake 520 is provided with: a hysteresis-ring 523; an electromagnetic coil or solenoid coil 524 serving as magnetic field control means; and a coil yoke 525 inducing magnetism of electromagnetic coil 524.

Hysteresis-ring 523 is attached to a rear end portion of intermediate rotating body 518 via a retainer plate 522 and projections 522*a* integrally disposed on a rear end face of retainer plate 522.

The power supply (the excitation current supply) to electromagnetic coil 524 is controlled by ECU 114 according to the engine operating condition.

Hysteresis-ring 523 is provided with: a base portion 523*a* of circular plate shape; and a cylindrical portion 523*b* coupled to the outer periphery side of base portion 523*a* via a screw 523*c*.

Respective projections 522*a* are pressed into bushes 521 disposed at even intervals in a circumferential direction, so that base portion 523*a* is coupled to retainer plate 522.

Further, Hysteresis-ring 523 is formed out of a material having a characteristic in which a magnetic flux thereof is changed with a phase delay to a change in external magnetic field (refer to FIG. 8), and cylindrical portion 523*b* receives a braking action of coil yoke 525.

Coil yoke 525 is formed to surround electromagnetic coil 524, and an outer peripheral face thereof is fixed to a cylinder head (not shown in the figure).

Further, the inner periphery side of coil yoke 525 supports camshaft 13 to be rotatable via a needle bearing 528, and also, supports the base portion 523*a* side of Hysteresis-ring 523 to be rotatable by means of a ball bearing 531.

Further, on the intermediate rotating body 518 side of coil yoke 525, there is formed a pair of opposing faces 526 and 527 facing each other via an annular clearance.

Figure 9:
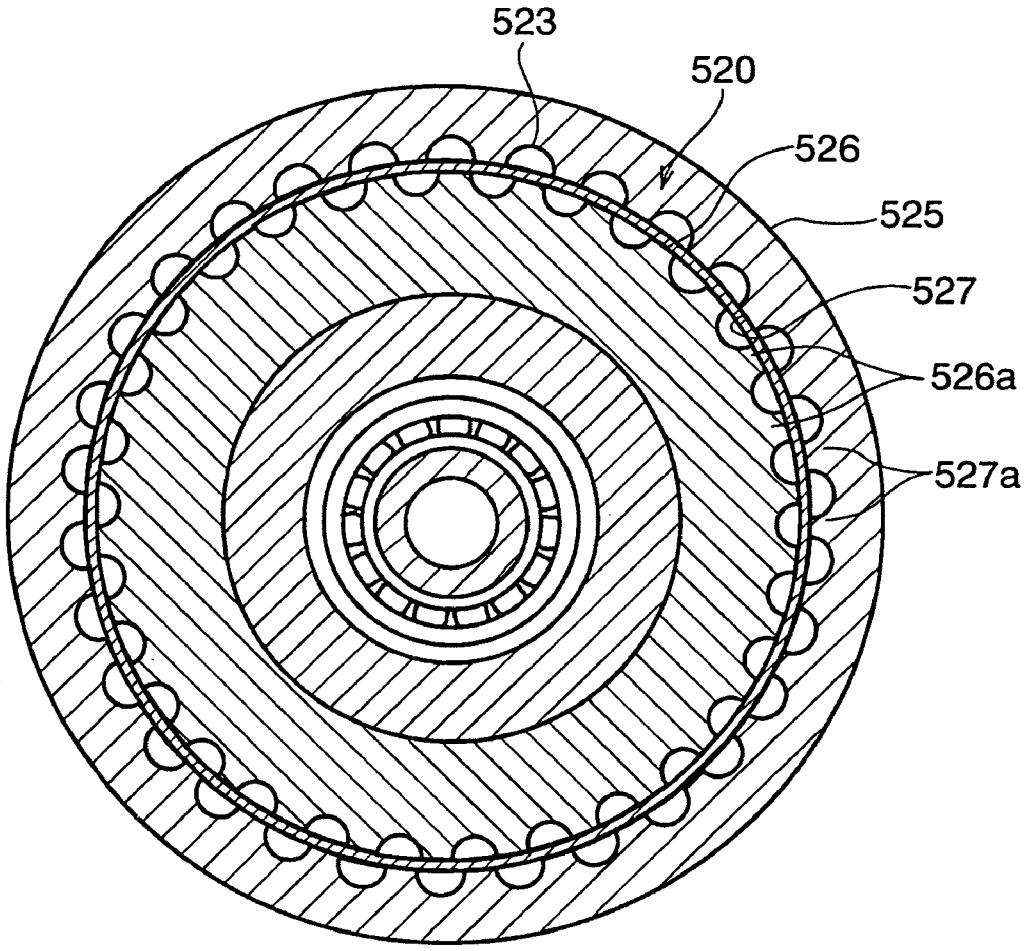
FIG. 9 is a diagram showing a hysteresis-brake in the variable valve timing control mechanism.

On respective opposing faces 526 and 527, a plurality of convex portions 526*a* and a plurality of convex portions 527*a*, are formed respectively at even intervals along respective circumferential directions thereof, as shown in FIG. 9.

Convex portions 526*a* of one opposing face 526 and convex portions 527*a* of the other opposing face 527 are arranged alternately in the circumferential direction, so that convex portions 526*a* and convex portions 527*a*, which are adjacent to each other, of mutual opposing faces 526 and 527, are all deviated to the circumferential direction.

Figure 10:
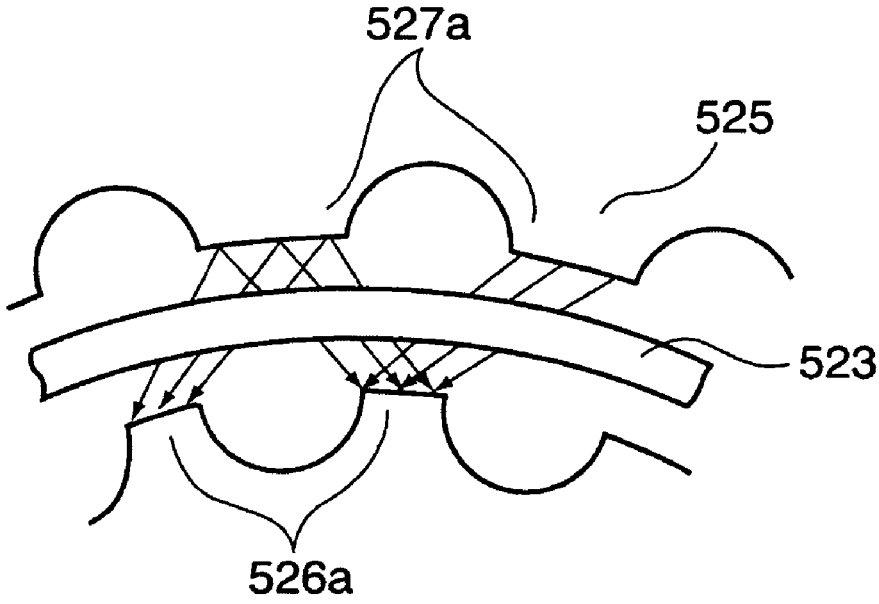
FIG. 10 is a diagram showing the orientation of a magnetic field in the hysteresis-brake.

Accordingly, between convex portion 526*a* and convex portion 527*a* which are adjacent to each other, of both opposing faces 526 and 527, a magnetic field oriented to incline toward the circumferential direction is generated by the magnetic excitation of electromagnetic coil 524 (refer to FIG. 10).

In the clearance between both opposing faces 526 and 527, cylindrical portion 523*a* of hysteresis-ring 523 is disposed so as to be in a non-contact state.

When hysteresis-ring 523 is displaced within the magnetic field between opposing faces 526 and 527, a braking force is generated due to the deviation between the orientation of the magnetic flux inside of hysteresis-ring 523 and the orientation of the magnetic field.

This braking force has a value approximately proportional to the strength of the magnetic field, that is, the magnitude of the excitation current for electromagnetic coil 524, irrespective of a relative speed between opposing faces 526 and 527, and hysteresis-ring 523.

According to VTC mechanism 113 of the above configuration, when the engine operation is stopped, electromagnetic coil 524 of hysteresis-brake 520 is turned off, so that intermediate rotating body 518 is rotated to the full to timing sprocket 502 in an engine rotational direction, by the force of spiral spring 519 (refer to FIG. 4), and a center phase of the operating angle of intake valve 105 is maintained at the most retarded angle side.

Then, when the engine operation is started from the above state, and electromagnetic coil 524 of hysteresis-brake 520 is excited based on a demand for changing the center phase to the advance angle side, the braking force against the force of spiral spring 519 is applied to intermediate rotating body 518.

As a result, intermediate rotating body 518 is rotated in a direction opposite to timing sprocket 520, and thus, engagement pin 516 on the tip end of link 511 is guided by spiral groove 515, so that the tip end portion of link 511 is displaced inward along radial groove 508.

Then, as shown in FIG. 5 and FIG. 6, an assembling angle between timing sprocket 502 and driven shaft member 507 is altered to the advance angle side due to the action of link 511, and the alteration of the assembling angle to the advance angle side is controlled depending on the magnitude of the excitation current for electromagnetic coil 524.

Incidentally, FIG. 5 shows a state where the center phase is maintained at the most advance angle side, and FIG. 6 shows a state where the center phase is maintained at the intermediate advance angle side.

Further, ECU 114 computes an advance angle target of the rotation phase in VTC mechanism 113, and feedback-controls the excitation current for electromagnetic coil 524 so that the actual rotation phase is coincident with the advance angle target.

In the above control of VTC mechanism 113, the correction on the inertia torque transmitted to VTC mechanism 113 and the correction on the cam torque from camshaft 13 are performed based on the rotational acceleration of the engine.

Figure 11:
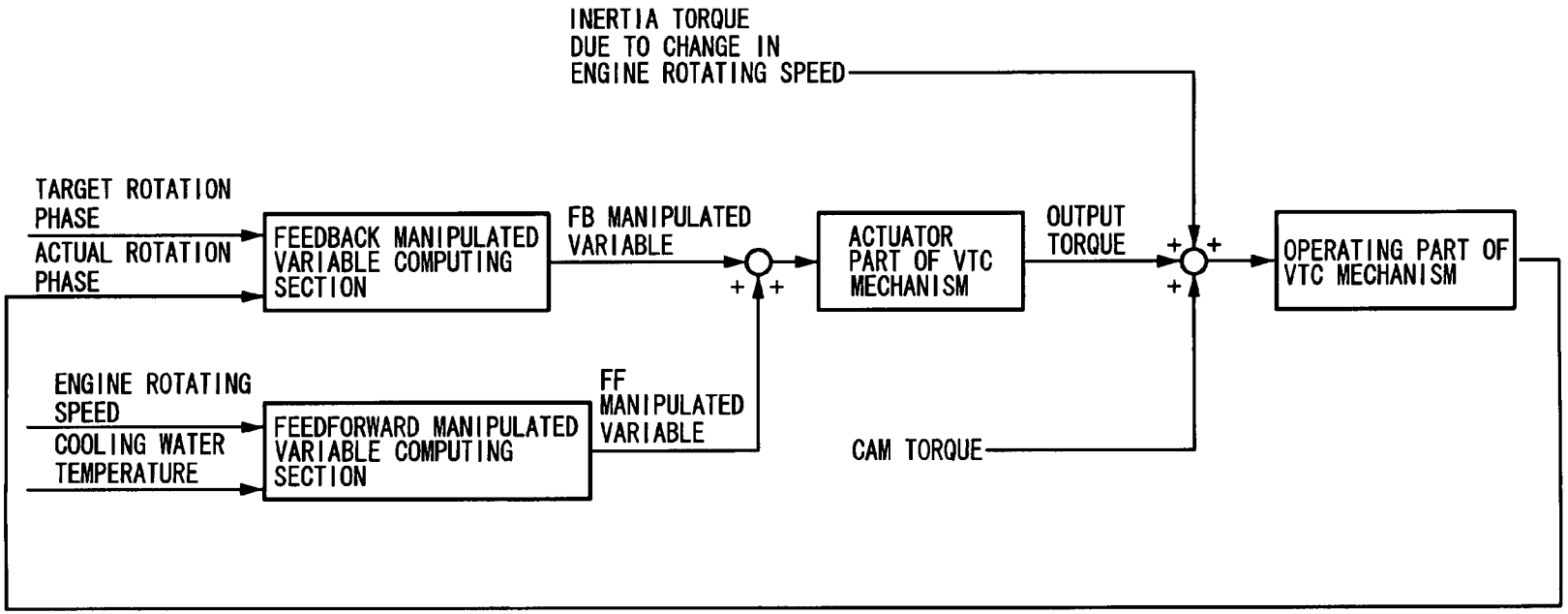
FIG. 11 is a block diagram showing the summary of a control in the variable valve timing control mechanism in the embodiment.

FIG. 11 shows a control block diagram in VTC mechanism 113.

A feedback manipulated variable computing section receives a target rotation phase which is the advance angle target of the rotation phase of camshaft 13 relative to crankshaft 120, and the actual rotation phase detected as in the above description, to compute a feedback manipulated variable (a value of the excitation current for electromagnetic coil 524) for VTC mechanism 113 based on the deviation between the target rotation phase and the actual rotation phase.

On the other hand, as described in the above, a change in the engine rotating speed Ne, that is, the inertia torque according to the rotational acceleration, and the cam torque from the camshaft, are transmitted to (an operating part of) VTC mechanism 113.

If an actuator part (electromagnetic coil 524 of hysteresis-brake 520) of VTC mechanism 113 is driven only with the feedback manipulated variable, the convergence of the rotation phase into the target rotation phase is delayed by a torque amount of the inertia torque and the cam torque.

Therefore, in the present embodiment, in order to cover a torque amount which offsetting the inertia torque and the cam torque by a VTC actuator, a feedforward manipulated variable computing section computes the offsetting torque amount as a feedforward manipulated variable.

Feedforward manipulated variable computing section is provided with: an inertia torque correction amount computing part that computes a correction amount according to the inertia torque; and a cam torque correction amount computing part that computes a correction amount according to the cam torque.

Figure 12:
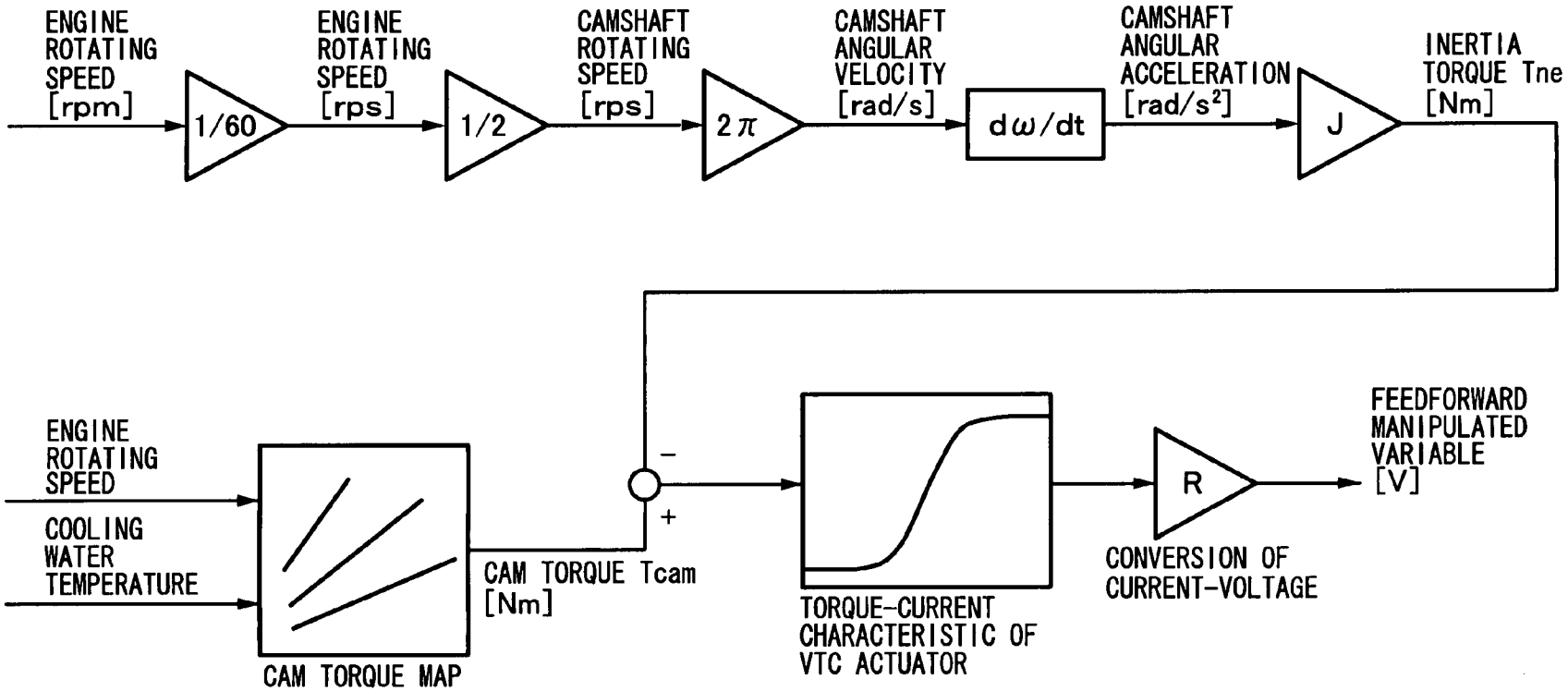
FIG. 12 is a block diagram showing the detail of a feedforward manipulated variable calculating section in the control in the variable valve timing control mechanism.

As shown in FIG. 12, the inertia torque correction amount computing part multiplies the engine rotating speed (rpm: number of rotations per minute) by 1/60 to transform it into the engine rotating speed (rps: number of rotations per second), and thereafter, multiples the transformed engine rotating speed by 1/2 to transform it into a rotating speed Ncam of camshaft 13, and further, multiplies the rotating speed Ncam by $2\pi$ to transform it into the angular velocity $\omega$.

Further, the inertia torque correction amount computing part differentiates the angular velocity $\omega$ (rad/s) of camshaft 13 to transform it into the angular acceleration $\alpha$ (rad/s$^2$), and multiplies the angular acceleration $\alpha$ by the inertia moment J of the operating part of VTC mechanism 113, to compute the inertia torque Tne which acts on the operating part (hysteresis-ring 523 and the like) of VTC mechanism 113.

This inertia torque Tne is transmitted to hysteresis-ring 523, and acts to advance the rotation phase when it has a positive value (when the engine rotating speed Ne is increasingly changed), while acting to retard the rotation phase when it has a negative value (when the engine rotating speed Ne is decreasingly changed).

The manipulated variable for VTC mechanism 113 is computed provided that a value thereof in an advance direction is a positive value. Therefore, in order to offset the action of the inertia torque Tne, the inertia torque Tne is transformed into a negative value to be input to a torque-current converting section of the VTC actuator as the correction amount according to the inertia torque. Incidentally, the transform of the inertia torque Tne into the negative value means that the transformed value is negative when the inertia torque Tne is calculated as the positive value, whereas when the inertia torque Tne is calculated as the negative value, since the negative value is transformed into a negative value, the transformed value is the positive value.

On the other hand, the cam torque correction amount computing part computes the cam torque Tcam by referring to a map, based on the engine rotating speed Ne and the cooling water temperature Tw.

The cam torque Tcam is transmitted to hysteresis-ring 523, and acts to retard the rotation phase. Therefore, the cam torque Tcam is input just as it is to the torque-current converting section of the VTC actuator, so that the torque in the advance direction, which offsets the retarding action by the cam torque Tcam, is generated to function as the correction amount according to the cam torque.

Then, a torque correction amount (=−Tne+Tcam) obtained by summing up the correction amount according to the inertia torque (negative value of the inertia torque Tne) and the correction amount according to the cam torque (cam torque Tcam), is converted into a current value by the torque-current converting section, and the converted current value is multiplied by a resistance R of the actuator part of VTC mechanism 113, to be subjected to the current/voltage conversion, so that the feedforward manipulated variable [V] is computed as a VTC drive voltage.

Thus, the total manipulated variable (drive voltage) obtained by adding the feedback manipulated variable computed by the feedback manipulated variable computing section and the feedforward manipulated variable computed by the feedforward manipulated variable computing section, is output to VTC mechanism 113 (electromagnetic coil 524).

As a result, VTC mechanism 113 is driven by the torque obtained by adding the correction torque amount for the inertia torque due to the engine rotation fluctuation transmitted from the engine and the cam torque, to the output torque from VTC mechanism 113.

Thus, the correction amount for offsetting the inertia torque transmitted from the engine and the cam torque is set as the manipulated variable for VTC mechanism 113, so that the delay in the convergence of the rotation phase into the target rotation phase due to the inertia torque and the cam torque can be prevented, and the convergence of the rotation phase into the target rotation phase can be performed in good response, and further, the operating performance, the fuel consumption and the like are improved.

Incidentally, in the present embodiment, the configuration is such that the correction for offsetting the inertia torque and the cam torque is performed. However, the configuration may be such that the correction for offsetting only the inertia torque is performed.

Further, the correction amount according to the inertia torque or the cam torque may be set as the feedforward manipulated variable, independent of the feedback manipulated variable, so that the prompt correction following the torque change can be performed, and valve characteristics can be converged into target valve characteristics as quickly as possible.

Further, as a second embodiment, the configuration may be such that, in the setting of the correction amount for the inertia torque, a gain of integration I (an integral gain I) in the feedback manipulated variable is changed. For example, the integral gain I in the advance direction (or in the retarded direction) may be increased and/or the integral gain I in the retarded direction (or in the advance direction) may be decreased, when the engine rotating speed Ne is increasingly changed (or decreasingly changed).

According to such a configuration, in the feedback control, the correction of the inertia torque can be performed.

Moreover, as a third embodiment, a dead band is provided in the inertia torque calculation, so that the inertia torque is calculated only at the predetermined rotation fluctuation or the rotation fluctuation above the predetermined rotation fluctuation.

According to such a configuration, the hunting can be suppressed by the correction on the inertia torque when the engine rotating speed is changed in minimum.

Furthermore, as in the above embodiments, a variable valve timing mechanism which changes the rotation phase of the camshaft relative to the crankshaft by the braking of the electromagnetic brake to which the present invention is applied, is susceptible to receive an torque influence from the exterior, compared with a mechanism in which the rotation phase in the advance direction and in the retarded direction is balanced to be changed by a hydraulic driving method. Consequently, it is possible to achieve the significant effect by applying the present invention.

However, the variable valve timing mechanism is not limited to VTC mechanism 113. A known mechanism can be appropriately adopted, and further, the present invention can be adapted to a friction braking type electromagnetic VTC performing the braking by a friction force.

Furthermore, the engine valve to which VTC mechanism 113 is disposed is not limited to intake valve 105, and it is possible to dispose VTC mechanism 113 to the side of exhaust valve 107, to control in the same manner as in the above embodiments.

The entire contents of Japanese Patent Application No. 2005-076246 filed on Mar. 17, 2005, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

I claim:

1. A variable valve control apparatus for an internal combustion engine, comprising:

a variable valve mechanism that varies operating characteristics of an engine valve of the internal combustion engine;

a rotating speed detector that detects an engine rotating speed; and a controller, which comprises: a rotational acceleration calculating section that calculates the rotational acceleration of the engine based on said detected engine rotating speed; an inertia torque calculating section that calculates the inertia torque transmitted to said variable valve mechanism, based on said calculated rotational acceleration; an inertia torque correction amount calculating section that calculates a correction amount of a manipulated variable for said variable valve mechanism, the correction amount being in compliance with said calculated inertia torque; a manipulated variable correcting section that corrects the manipulated variable for said variable valve mechanism with said calculated correction amount; and a control section that controls said variable valve mechanism based on said corrected manipulated variable.

2. The apparatus according to claim 1, wherein said controller further comprises:

a cam torque calculating section that calculates the cam torque of a cam which drives the engine valve; and a cam torque correction amount calculating section that calculates a correction amount of the manipulated variable for said variable valve mechanism, the correction amount being in compliance with said calculated cam torque, and wherein said manipulated variable correcting section corrects the manipulated variable for said variable valve mechanism with the correction amount according to the inertia torque and also the correction amount according to said cam torque.

3. The apparatus according to claim 1, wherein said inertia torque correction amount calculating section sets the correction amount according to the inertia torque as a feedforward manipulated variable.

4. The apparatus according to claim 2, wherein said cam torque correction amount calculating section sets the correction amount according to the cam torque as a feedforward manipulated variable.

5. The apparatus according to claim 2, wherein said cam torque calculating section calculates the cam torque, based on the detection value of the engine rotating speed and a detection value of the engine temperature.

6. The apparatus according to claim 1, wherein said variable valve mechanism is a variable valve timing control mechanism which changes a rotation phase of a camshaft relative to a crankshaft by the braking of an electromagnetic brake to vary opening/closing timing of the engine valve.

7. The apparatus according to claim 6, wherein said variable valve timing control mechanism comprises:

a driving member to which a rotating force is transmitted from said crankshaft;

a driven member disposed integrally with said camshaft;

an intermediate rotating body disposed between said driving member and said driven member, which is relatively rotated to said driving member, to increase/decrease the rotation transmitted to said driven member; and an electromagnetic actuator which relatively rotates said intermediate rotating body to said driving member.

8. The apparatus according to claim 6, wherein the manipulated variable for said variable valve timing control mechanism is set as an advance angle amount for the rotation phase of said camshaft relative to the crankshaft, and also acts to advance the rotation phase when the inertia torque has a positive value, and said inertia torque correction amount calculating section calculates the correction amount according to the inertia torque as a manipulated variable amount which generates the torque whose sign is inverted from the positive or negative sign of the calculated inertia torque.

9. The apparatus according to claim 1, wherein said inertia torque correction amount calculating section calculates the correction amount according to the inertia torque as a correction amount for changing an integral gain in a feedback control.

10. The apparatus according to claim 1, wherein said inertia torque correction amount calculating section calculates the correction amount according to the inertia torque only when a change in the engine rotating speed is equal to or larger than a predetermined change.

11. A variable valve control apparatus for an internal combustion engine, comprising:

a variable valve mechanism which varies operating characteristics of an engine valve in the internal combustion engine;

rotating speed detecting means for detecting an engine rotating speed;

rotational acceleration calculating means for calculating the rotational acceleration of the engine based on the engine rotating speed detected by said rotating speed detecting means;

inertia torque calculating means for calculating the inertia torque transmitted to said variable valve mechanism, based on said calculated rotational acceleration;

inertia torque correction amount calculating means for calculating a correction amount of a manipulated variable for said variable valve mechanism, the correction amount being in compliance with said calculated inertia torque;

manipulated variable correcting means for correcting the manipulated variable for said variable valve mechanism with said calculated correction amount according to the inertia torque; and control means for controlling said variable valve mechanism based on said corrected manipulated variable.

12. A control method for an internal combustion engine provided with a variable valve mechanism which varies operating characteristics of an engine valve, comprising the steps of:

detecting an engine rotating speed;

calculating the rotational acceleration of the engine based on the detected engine rotating speed;

calculating the inertia torque transmitted to said variable valve mechanism, based on said calculated rotational acceleration;

calculating a correction amount of a manipulated variable for said variable valve mechanism, the correction amount being in compliance with said calculated inertia torque;

correcting the manipulated variable for said variable valve mechanism with said calculated correction amount according to the inertia torque; and controlling said variable valve mechanism based on said corrected manipulated variable.

13. The method according to claim 12, further comprising the steps of:

calculating the cam torque of a cam which drives the engine valve; and calculating a correction amount according to said calculated cam torque, of the manipulated variable for said variable valve mechanism, wherein said step of correcting the manipulated variable for said variable valve mechanism corrects the manipulated variable for said variable valve mechanism with the correction amount according to the inertia torque and also the correction amount according to said cam torque.

14. The method according to claim 12, wherein said step of calculating the correction amount according to the inertia torque sets the correction amount according to the inertia torque as a feedforward manipulated variable.

15. The method according to claim 13, wherein said step of calculating the correction amount according to the cam torque sets the correction amount according to the cam torque as a feedforward manipulated variable.

16. The method according to claim 13, wherein said step of calculating the correction amount according to the cam torque calculates the cam torque, based on the detection value of the engine rotating speed and a detection value of the engine temperature.

17. The method according to claim 12, wherein said variable valve mechanism is a variable valve timing control mechanism which changes a rotation phase of a camshaft relative to a crankshaft by the braking of an electromagnetic brake to vary opening/closing timing of the engine valve, and the manipulated variable thereof is set as an advance angle amount for the rotation phase of said camshaft relative to the crankshaft, and also acts to advance the rotation phase when the inertia torque has a positive value; and said step of calculating the correction amount in compliance with the inertia torque calculates the correction amount according to the inertia torque as a manipulated variable amount which generates the torque whose sign is inverted from the positive or negative sign of the calculated inertia torque.

18. The method according to claim 12, wherein said step of calculating the correction amount in compliance with the inertia torque calculates the correction amount in compliance with the inertia torque as a correction amount for changing an integral gain in a feedback control.

19. The method according to claim 12, wherein said step of calculating the correction amount in compliance with said calculated inertia torque calculates the correction amount in compliance with only when a change in the engine rotating speed is equal to or larger than a predetermined change.

* * * * *